US008505597B2

(12) United States Patent
Sharperson

(10) Patent No.: US 8,505,597 B2
(45) Date of Patent: Aug. 13, 2013

(54) MULTI-POSITION ROTATING CABINET FOR THE STORAGE AND DEPLOYMENT OF POWER TOOLS

(76) Inventor: Michael Sharperson, Los Angeles, CA (US)

( * ) Notice: Subject to any disclaimer, the term of this patent is extended or adjusted under 35 U.S.C. 154(b) by 207 days.

(21) Appl. No.: 12/932,355

(22) Filed: Feb. 24, 2011

(65) Prior Publication Data

US 2012/0217850 A1 Aug. 30, 2012

(51) Int. Cl.
*B25H 1/00* (2006.01)

(52) U.S. Cl.
USPC ..... 144/286.5

(58) Field of Classification Search
USPC .... 144/286.1, 286.5; 108/77–82; 312/249.8, 312/312, 306
See application file for complete search history.

(56) References Cited

U.S. PATENT DOCUMENTS

| | | | | |
|---|---|---|---|---|
| 888,079 | A | 5/1908 | Furman | |
| 1,094,996 | A | 4/1914 | Jacoway | |
| 4,183,594 | A * | 1/1980 | Mey et al. | 312/27 |
| 5,274,731 | A | 12/1993 | White | |
| 5,692,246 | A | 12/1997 | Benedick | |
| D393,541 | S | 4/1998 | Calmeise | |
| 5,743,833 | A | 4/1998 | Watterson et al. | |
| D397,585 | S | 9/1998 | Rausch et al. | |
| 5,951,127 | A | 9/1999 | Smith | |
| 5,975,660 | A | 11/1999 | Tisbo et al. | |
| D465,351 | S | 11/2002 | Tobin, Jr. | |
| 6,554,697 | B1 | 4/2003 | Koplin | |
| D492,509 | S | 7/2004 | Anderson et al. | |
| D501,615 | S | 2/2005 | Chen | |
| D574,771 | S | 8/2008 | Flanigan | |
| 2003/0188804 | A1 * | 10/2003 | Hill | 144/286.5 |

* cited by examiner

*Primary Examiner* — Dana Ross
*Assistant Examiner* — Matthew G Katcoff
(74) *Attorney, Agent, or Firm* — Cislo & Thomas, LLP

(57) ABSTRACT

A multi-position cabinet for use with machine tools which provides a solution to the problem of limited shop space in which to install bench type power tools is provided. The invention comprises a rotating rectangular cabinet which contains workstations from which bench type power tools can be deployed from a stowed position to a working position. The invention includes means for raising the cabinet off its base so that the cabinet can be rotated to bring each workstation to the topmost position from which the power tool associated with that work station can be deployed. In one exemplary embodiment, the workstations include a drill press, table saw, miter saw and belt sander. The invention is not limited to use with power tools, but rather is suitable for use in any application where it is desirable to provide multiple workstations in a comparatively compact package.

16 Claims, 16 Drawing Sheets

MULTI-POSITION ROTATING CABINET FOR THE STORAGE AND DEPLOYMENT OF POWER TOOLS

FIELD OF THE INVENTION

The present invention relates generally to the field of workbenches for mounting power tools, and more particularly to a space saving, rotating cabinet for the storage and deployment of multiple power tools.

BACKGROUND OF THE INVENTION

Previously, it has been desirable to have various bench mounted electrically powered workshop tools all mounted on a single large work bench, or more commonly, on several smaller workbenches. Unfortunately, space limitations in home workshops often restrict the installation of a single workbench of sufficient size to accommodate the range of bench mounted power tools typically found in a well equipped home workshop. These same space limitations also typically restrict mounting the tools on several smaller workbenches. There have been many attempts to deal with the problem of providing home craftsman the opportunity to use a number of different power tools in a limited space. In bygone eras when homes often included barns or other outbuildings where a separate workshop could be established the issue of lack of space to install bench mounted tools was less of a problem. However, in the present age which features homes with generally smaller lot sizes and few if any outbuildings, and where, in general, workshop space has shrunk in favor of home living space, the need for a space saving device which can store multiple bench tools and yet readily deploy such tools for use has grown more acute.

Many different power tool workbenches have been proposed over the years. Representative samples include U.S. Pat. No. 4,105,055 to Brenta, U.S. Pat. No. 4,523,617 to Tidemann, U.S. Pat. No. 5,722,473 to Tucker, and U.S. Pat. No. 7,077,179 to Camiano et al., among many others. However, it appears likely that most of these prior art workbenches or multi-tool work stations would meet with limited commercial success due to one or more of the following drawbacks, i.e. high cost, inability to provide ready access to a variety of bench style tools, impractical to manufacture due to excessive complexity, and overly time consuming tool change over.

Consequently, there remains a need in the art for a device that will provide home craftsman with access to the most commonly desired bench mounted power tools. Such tools would likely include a drill press, table saw, belt sander, and miter saw, among others. It is the purpose of the present invention to provide a device that stores and deploys for use bench mounted power tools. The device should take up a minimum of space, i.e. about the same space as a single workbench of modest size, and the tools should be easy for the home craftsman to deploy for use.

SUMMARY OF THE INVENTION

The present invention solves the problem of limited shop space in which to install power tools by providing a rotating rectangular cabinet in which is mounted, in the exemplary embodiment, with four bench type power tools. In the exemplary embodiment these tools include a drill press, table saw, miter saw and belt sander, each of which is installed inside the cabinet below one of the faces of the cabinet in such manner that the tool can be deployed for use from the interior of the cabinet to an upright position on a corresponding exterior face of the cabinet, when that face has been rotated to the top position. The four exterior faces of the cabinet essentially provide four workstations from which tools may be deployed from stowed positions inside the cabinet to an exterior position on the cabinet for use.

The novel design of the present invention cabinet and workstation allows a power tool to be easily deployed from inside the cabinet to a corresponding workbench top and made ready for use. Likewise, when the need for a particular tool is finished, the tool may be readily stowed for storage inside the cabinet and the cabinet rotated until the face or workstation containing the next tool desired to be used is in the top position.

Although the invention is described in the exemplary embodiment with reference to power tools, the invention should not be construed as being limited to use with power tools. Rather, the invention is suitable for use in any application where it is desirable to provide multiple workstations in a comparatively compact package. For example, various kitchen appliances, among other devices, could be substituted for power tools.

DETAILED DESCRIPTION OF THE PREFERRED EMBODIMENTS

The present invention will now be described more fully hereinafter with reference to the accompanying drawings, in which preferred embodiments of the invention are shown. The invention may, however, may be embodied in many different forms and should not be construed as being limited to the embodiments set forth herein. Rather these embodiments are provided so that this disclosure will be thorough and complete, and will fully convey the scope of the invention to those skilled in the art. Like numbers refer to like elements throughout.

Figure 1:
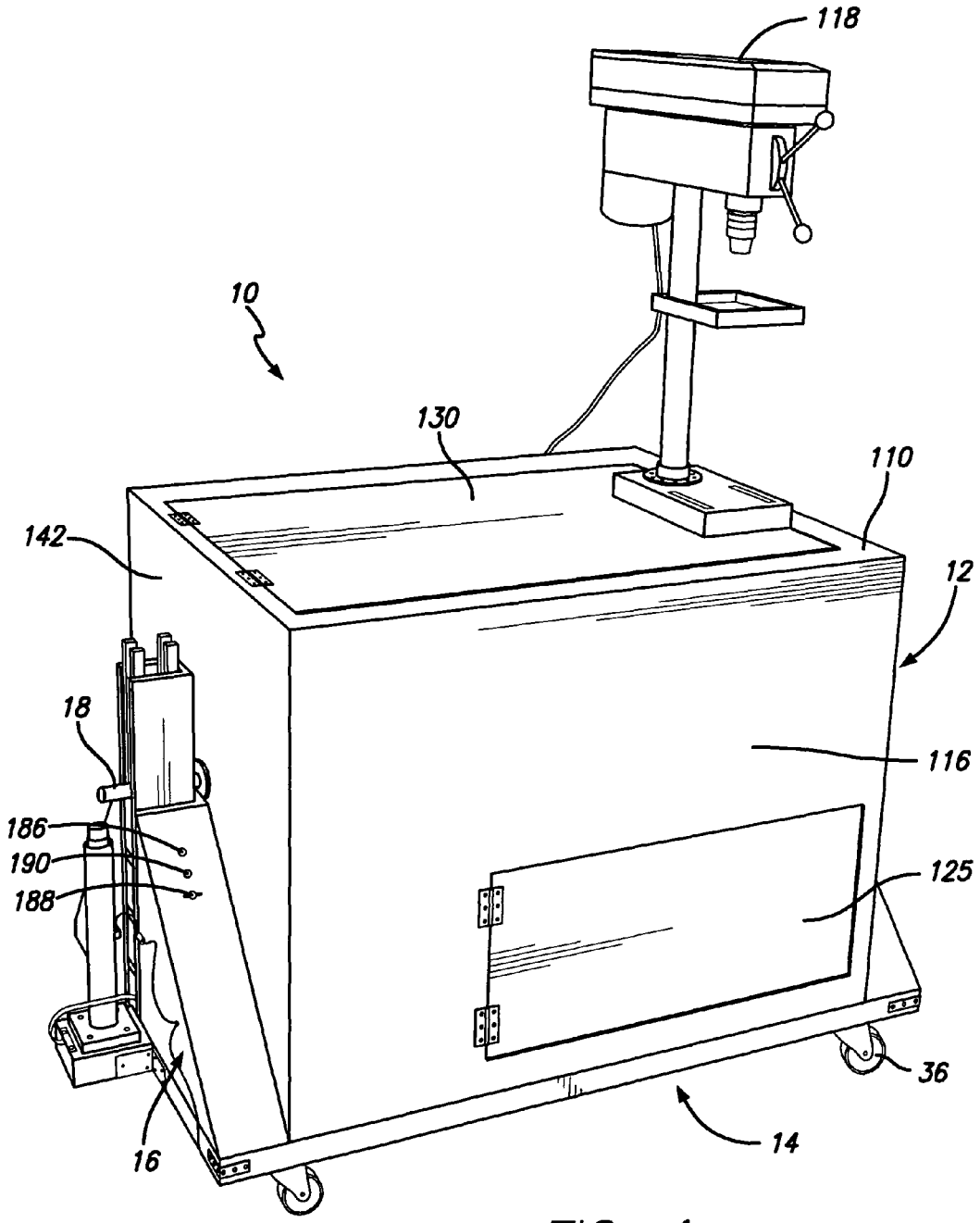
FIG. 1 is a perspective view showing the rotating cabinet and workstation of the present invention in its lowered position.
Figure 2:
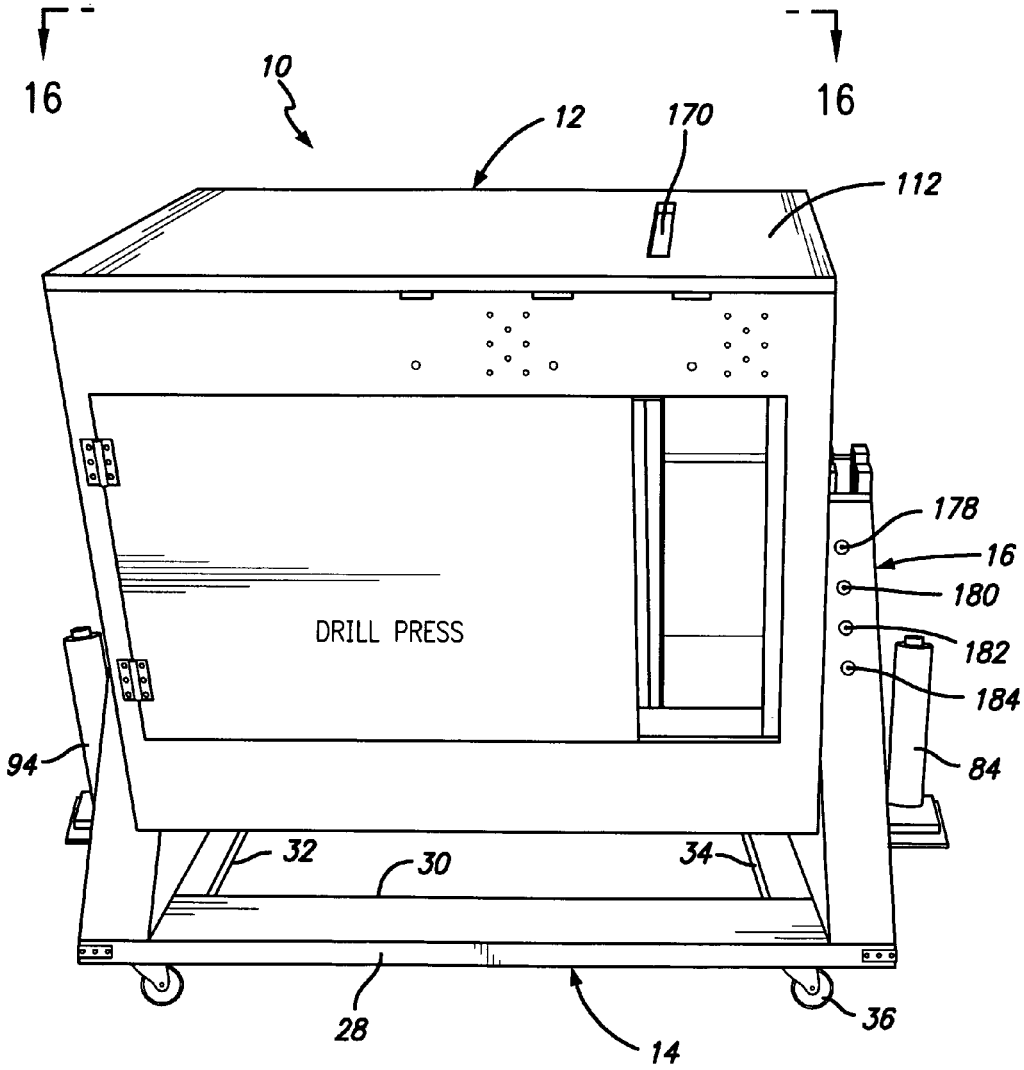
FIG. 2 is a perspective view showing the rotating cabinet and workstation of FIG. 1 in its raised position.
Figure 3:
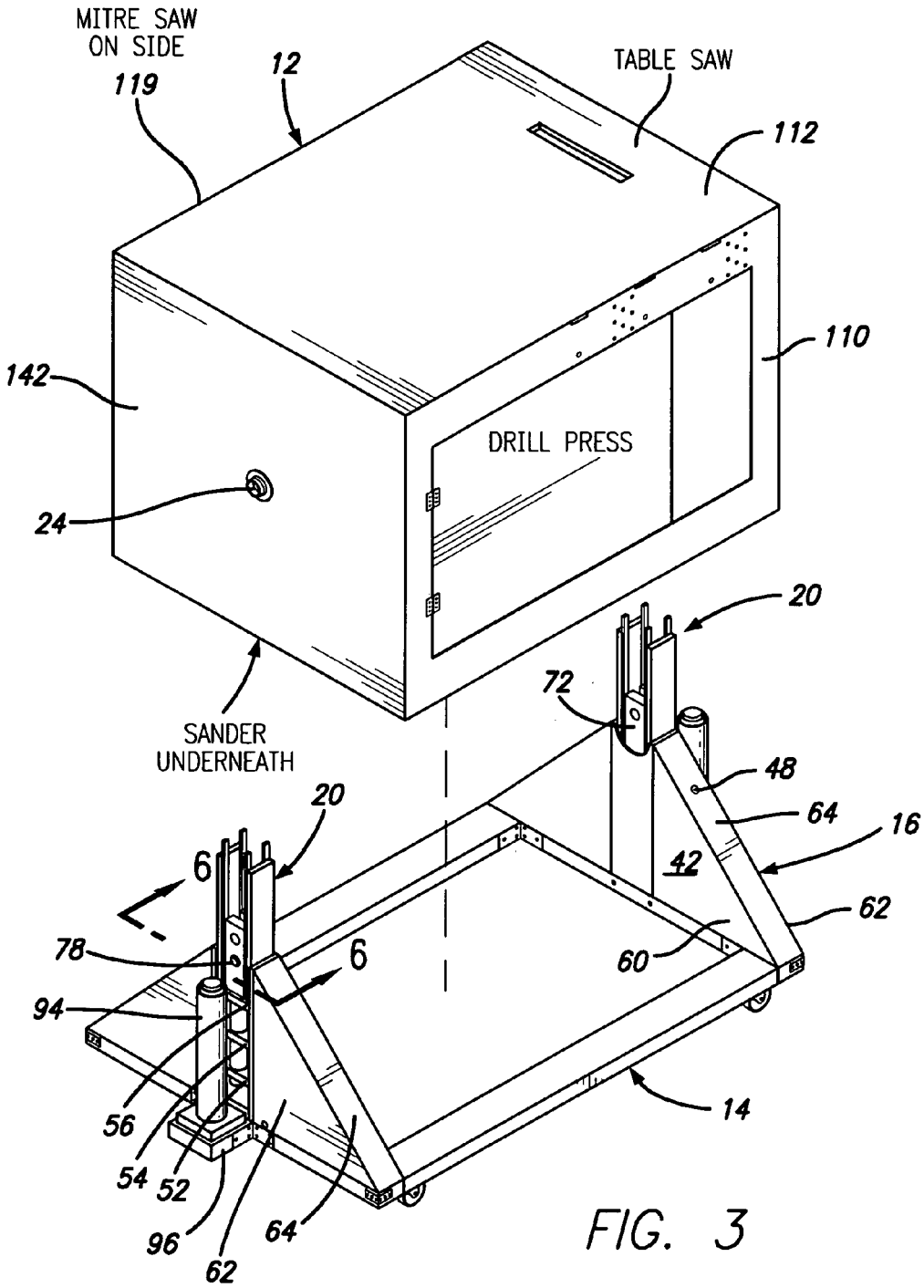
FIG. 3 is an exploded perspective view showing of rotating cabinet and workstation of FIG. 1.

With reference to FIGS. 1-3, the present invention multi-position cabinet and workstation 10 comprises a cabinet structure 12, a base assembly 14, and right and left triangular support assemblies 16. The cabinet 12 is attached to the right and left triangular support assemblies 16 by means of right and left pins 18 (see FIG. 1) which pass through right and left holes 22 (see FIG. 3) in right and left slide assemblies 20 which form part of the right and left triangular support assemblies 16. The pins 18 interface with the cabinet 12 via sockets 24 which are attached to the cabinet 12. (See FIG. 3). The pins 18 are hollow and allow electrical wiring to pass from cord dispensers 94 into the cabinet 12. In one exemplary embodiment, the pin comprised a ⅝" diameter steel tube. Air cylinders 26 housed within the triangular support assemblies 16 are used to raise and lower the cabinet 12.

In use, air pressure is applied to the cylinders 26, raising the cabinet off of the base assembly 14. When raised, the cabinet may be rotated to any of four faces or workstations each of which corresponds to a particular or tool. (See FIG. 2.) When the desired tool has been chosen, air is released from the cylinders 26 allowing the cabinet 12 to rest in a stable position on the base assembly 14. (See FIG. 1.) It should be noted that means for raising the cabinet is not limited to air cylinders, rather hydraulic cylinders, motorized ball screws and other like devices may be substituted for air cylinders.

Referring now to FIGS. 1-2, the base assembly 14 of the present invention is discussed in more detail. The base comprises two opposed longitudinal members 28 (shown in FIGS. 1 and 2) and 30 (not shown, located opposite from 28) and two opposed transverse members 32 and 34 (best shown in FIG. 2). The base assembly is joined to form an integral unit and may optionally include wheels or casters 36. The base may be constructed from many materials including wood, metals such as steel or aluminum or from structural plastics. What is important is not the particular material from which the base 14 is made but rather that the base 14 be sufficiently strong and rigid to support the weight of, and provide a stable support for, the triangular support assemblies 16, the cabinet 12 and the machine tools contained within the cabinet 12.

Referring now to FIGS. 1-5, the right and left triangular support assemblies 16 will be described. The right and left triangular support assemblies 16 are mirror images of each other. Therefore, only one assembly need be discussed in detail. The triangular support assembly 16 includes an air cylinder support assembly 38 which supports the air cylinder 26, right and left triangular sections 42. An electrically driven air pump 44 which supplies pressurized air to the air cylinder 26 along with electrical wiring for tool control may be housed within the triangular sections 42. The triangular support assembly 16 also includes the slide assembly 20.

Figure 4:
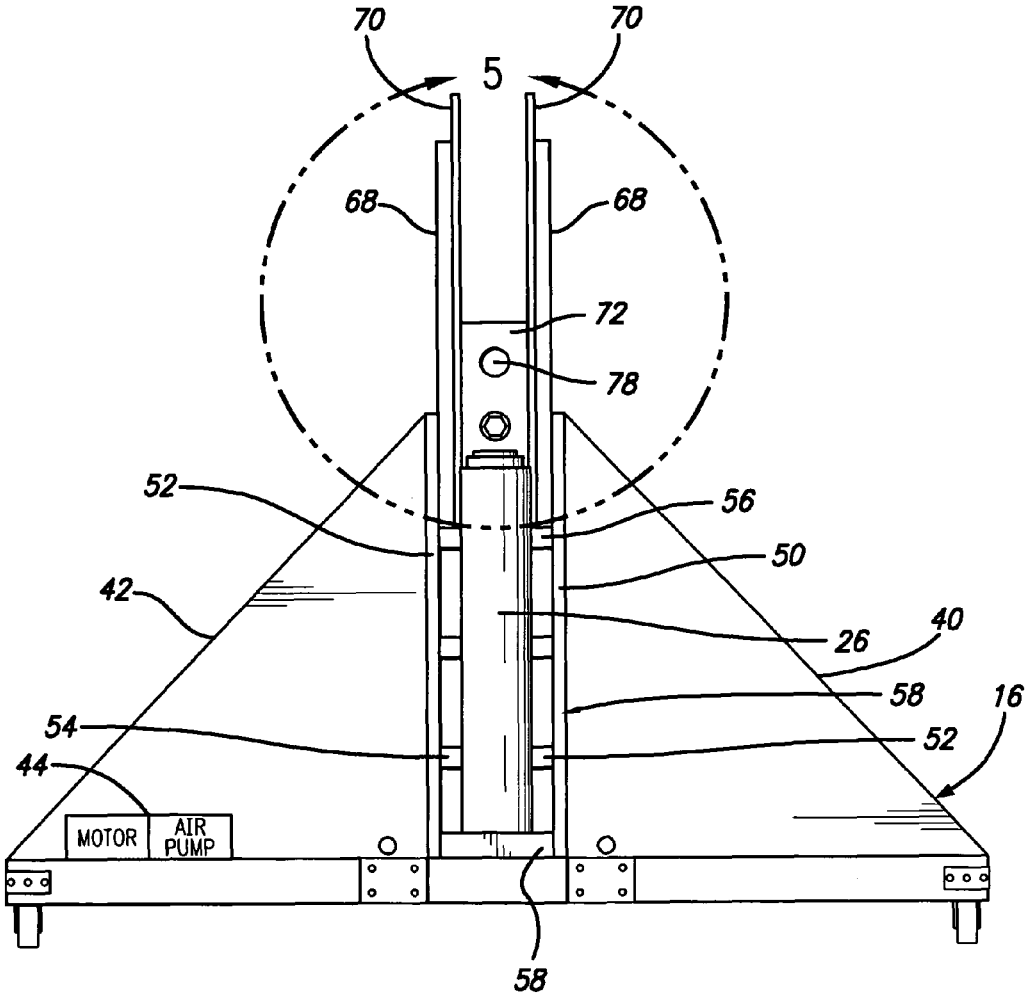
FIG. 4 is a side view of one of the triangular supports of the cabinet and workstation of FIG. 1, showing a slide assembly.

Referring now to FIGS. 3 and 4, the air cylinder support assembly 38 comprises left and right vertical support panels 50 and 52. Fastened to the vertical support panels 50 and 52 are base 58, lower 52, middle 54 and upper 56 horizontal air cylinder supports. Each of supports 52, 54, 56 and 58 includes a round hole sized to form a slip fit with the round body of the air cylinder 26. With continued reference to FIGS. 3 and 4, the triangular support assembly 16 includes two triangular support sections 42. The sections are mirror images of each other. The triangular support section 42 is intended to provide lateral support to the air cylinder support assembly 38. Each support includes an inside triangular panel 60, an outside triangular panel 62 and top panel 64. When attached together these three panels form a rigid support and the assembly 42 is then attached along its vertical side to the support panels 50, 52 of the air cylinder support assembly 38. Along its horizontal edge the section 42 is attached to the base assembly 14.

Figure 5:
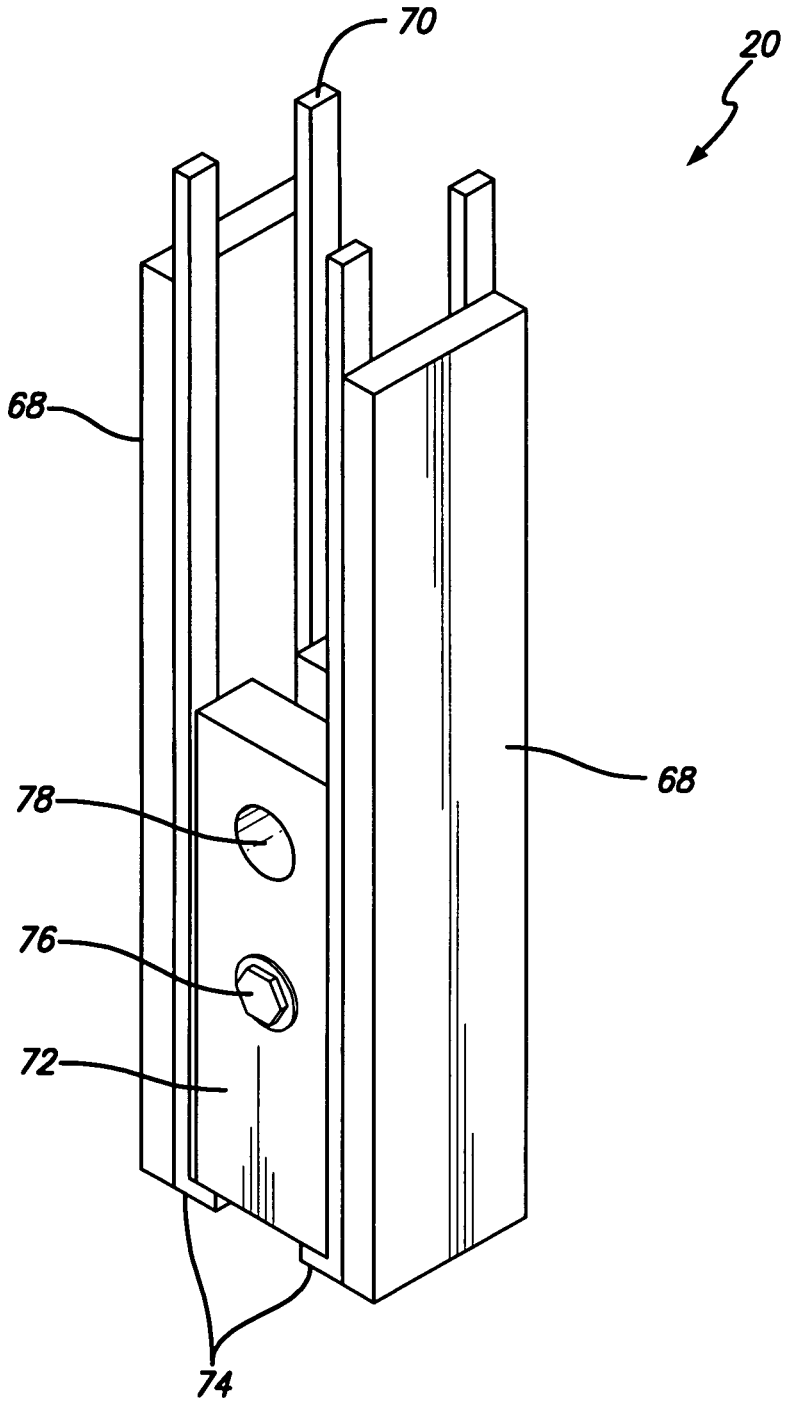
FIG. 5 is an enlarged detailed view, encompassed by circle 5, of the slide assembly shown in FIG. 4.
Figure 7:
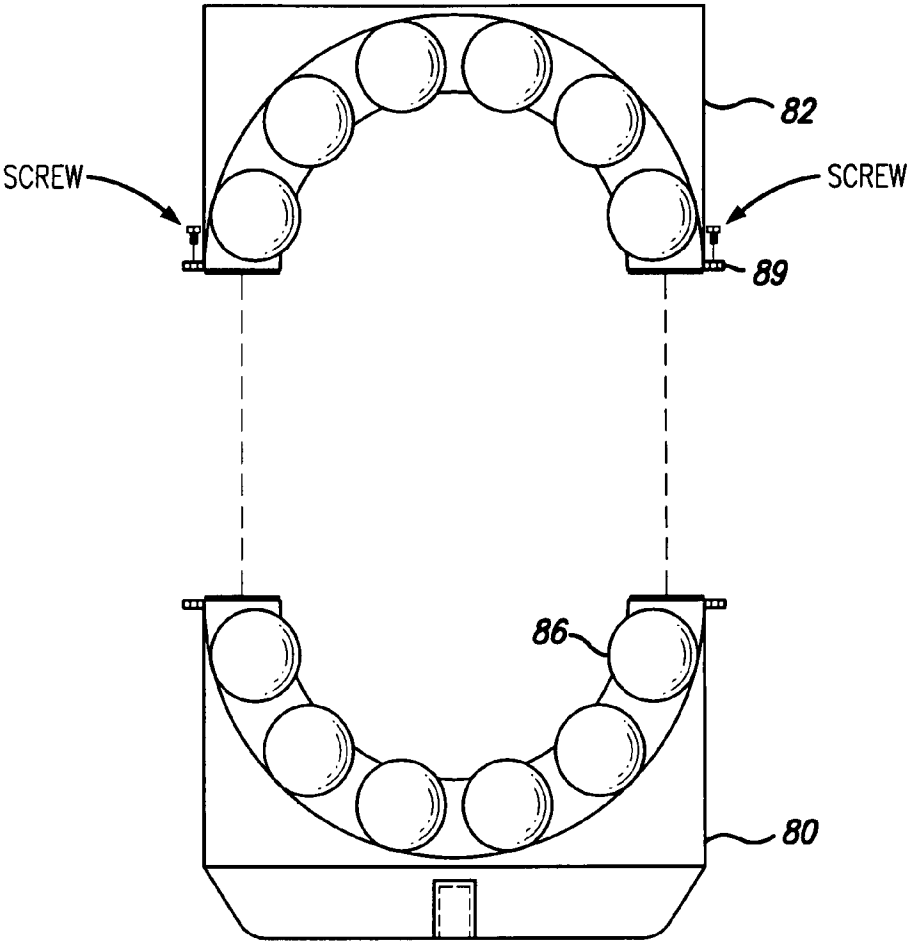
FIG. 7 is side view of the bearing block assembly of FIG. 6.

Referring now to FIGS. 3-5, each triangular support assembly 16 also includes the slide assembly 20 (best shown in FIGS. 4 and 5). The slide assembly 20 includes two side plates 68. Mounted along the opposing longitudinal ends of each side plate 68 are tracks 70 (best seen in FIG. 5). Each track 70 includes an L-shaped foot at its base. Fitted between each pair of opposing tracks is a slide block 72. Each block 72 includes two holes, i.e. a lower hole 76 and an upper hole 78.

Figure 6:
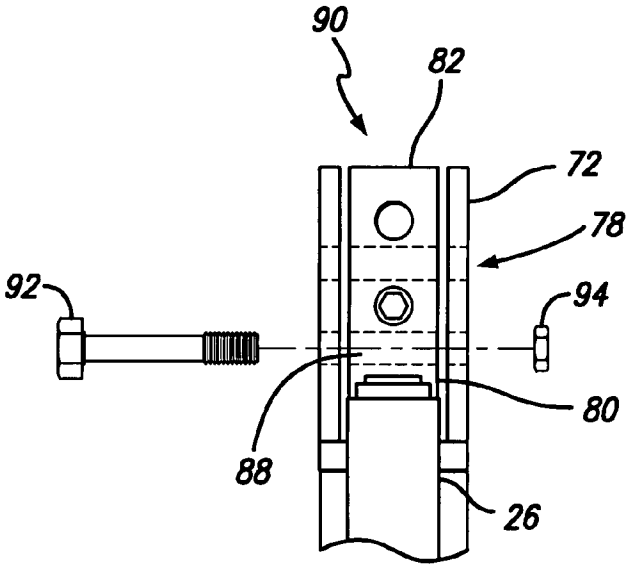
FIG. 6 is a partial side section view taken along the line B-B of FIG. 3, showing of the slide blocks and bearing block of the present invention and a portion of an air cylinder.

Referring now to FIG. 6, another view of the slide assembly is shown. Sandwiched between side slide blocks 72 is a bearing block assembly 90 containing ball bearings 86. The bearing block 90 comprises a lower fitting 80 and an upper fitting 82. The lower fitting of the bearing block assembly 80 includes a provision for attaching to the movable rod of the air cylinder 26. During assembly of the multi-position cabinet assembly 10, the hollow pin 18 which protrudes from the cabinet 12 is positioned in the lower fitting 80. Thereafter, the upper fitting 82 is attached to the lower fitting by screws or other means known in the art to create a 360 degree ball bearing race for the pin 18. The lower fitting 80 is designed to attach to the rod end 27 of the air cylinder 26. The fitting 80 includes a hole 88. A bolt 92 passes through the holes 76 in the slide blocks 72 and the hole 88 in lower fitting 80. When a nut 94 is attached to the bolt 92 the slide blocks 72 and bearing assembly 90 are compressed and held together within the slide assembly 20 as a unit. The bearing block 90 is designed so that the holes 78 in each slide block 72 are co-linear with the inside diameter of the bearing block 90.

Figure 17:
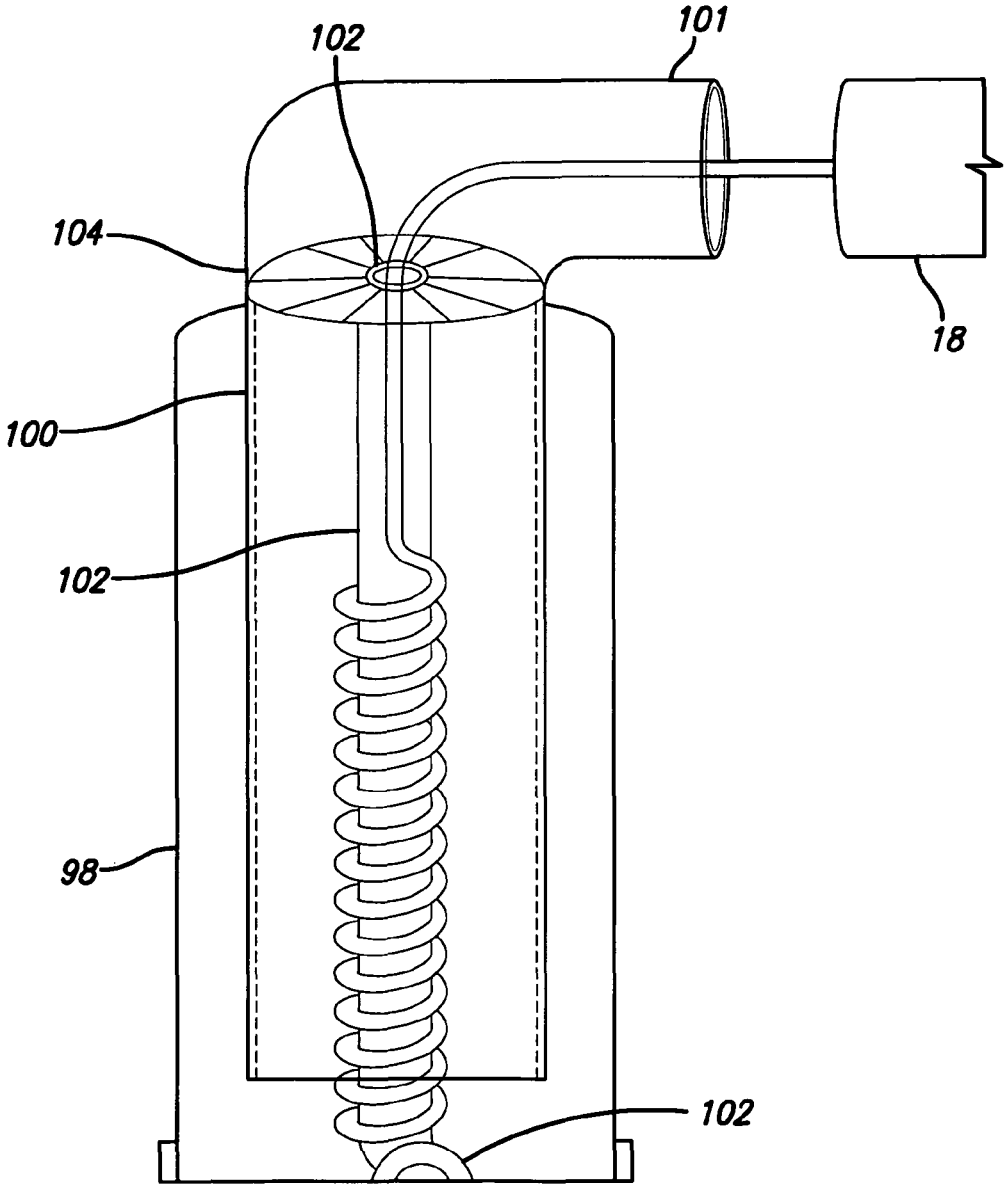
FIG. 17 is partial sectional view of the electrical cord storage mechanism shown in FIGS. 1-3 of the present invention.

Referring now to 17, a wire storage device 94 is shown. The wire storage device 94 is attached to the frame assembly 14 via a pad 96 which extends outwardly from the frame assembly. (See FIG. 3.) One wire storage device 92 is located each triangular support assembly 16. The wire storage device includes two cylindrical telescoping tubes, i.e. the outside tube 98 and the inside tube 100. Tube 98 is equipped with an anchor 102 at its lower end and tube 100 is equipped with an anchor 102 at its upper end. Between the two anchors is a bungee cord 102. Wiring may be wrapped as shown FIG. 17 around the bungee cord such so that when the cabinet 12 is raised and lowered, the inner tube 100 raises and lowers along with the cabinet. In this manner, all wiring used to provide power to air pump and machine tools is kept neatly within the cylinders 98 and 100 of the wire storage device 94. Inner tube 100 is connected to an elbow tube 101 which in turn connects to the hollow pin 18. Hence when the cabinet 12 is raised and lowered, elbow tube 101 causes the telescoping tube 100 and the associated wiring contained therein to raise and lower. In the exemplary embodiment of the present invention 10, main power wiring for the air pump and machine tools was installed in one of the wire storage devices 94, while control wiring for the machine tools was stored in the other wire storage device 94 located on the opposite end of the frame assembly 14.

Referring now to FIGS. 1-3, the cabinet 12 of the present invention 10 will be described. The cabinet 12 is a rectangular structure having four faces corresponding to different tool work stations. Face 110 corresponds to a work station for a deployable drill press 118. Face 112 corresponds to a work station for a deployable table saw 120. Face 114 corresponds to a work station for a deployable miter saw 122 (see FIGS. 13-14). Face 116 corresponds to a work station for a deployable sander 124. Each of the faces 110, 112, 114 and 116 is connected to side panels 140, of which there is one at each side of the cabinet.

Figure 8:
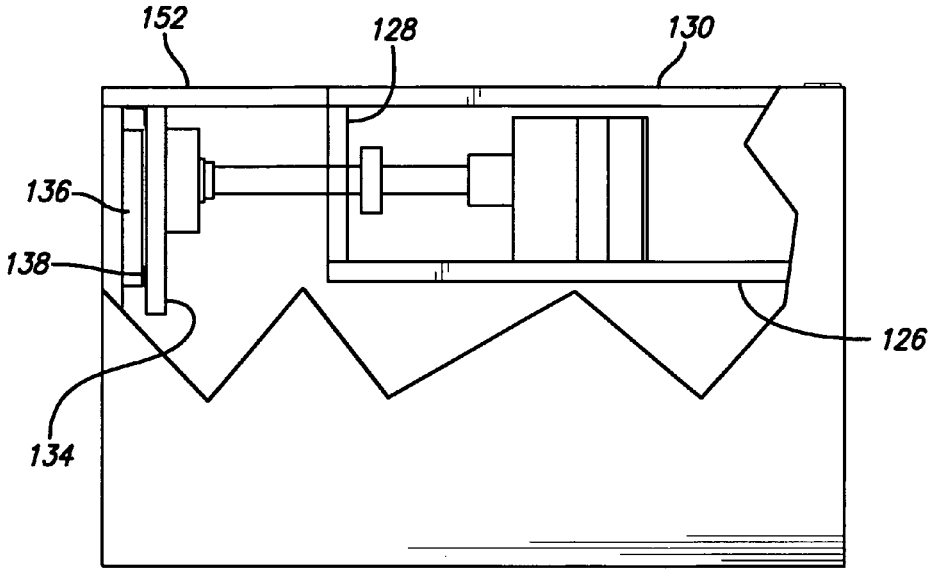
FIG. 8 is a side view, partially cutaway, of the rotating cabinet of FIG. 1, showing the drill press work station in the topmost position and the drill press in the stowed position within the cabinet.
Figure 9:
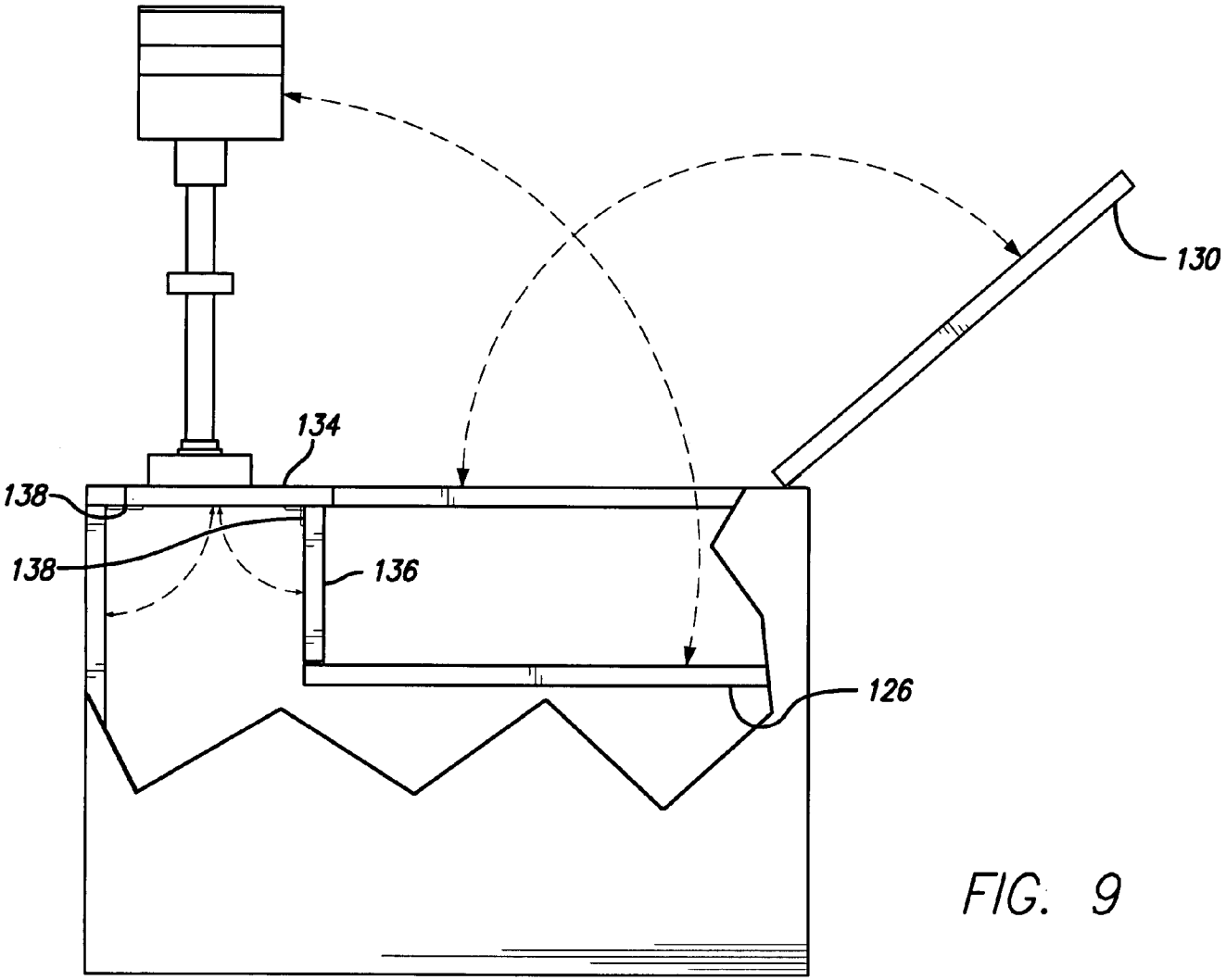
FIG. 9 is a side view, partially cutaway, of the rotating cabinet and workstation of FIG. 1, showing the drill press work station in the topmost position and the drill press in the deployed position.
Figure 10:
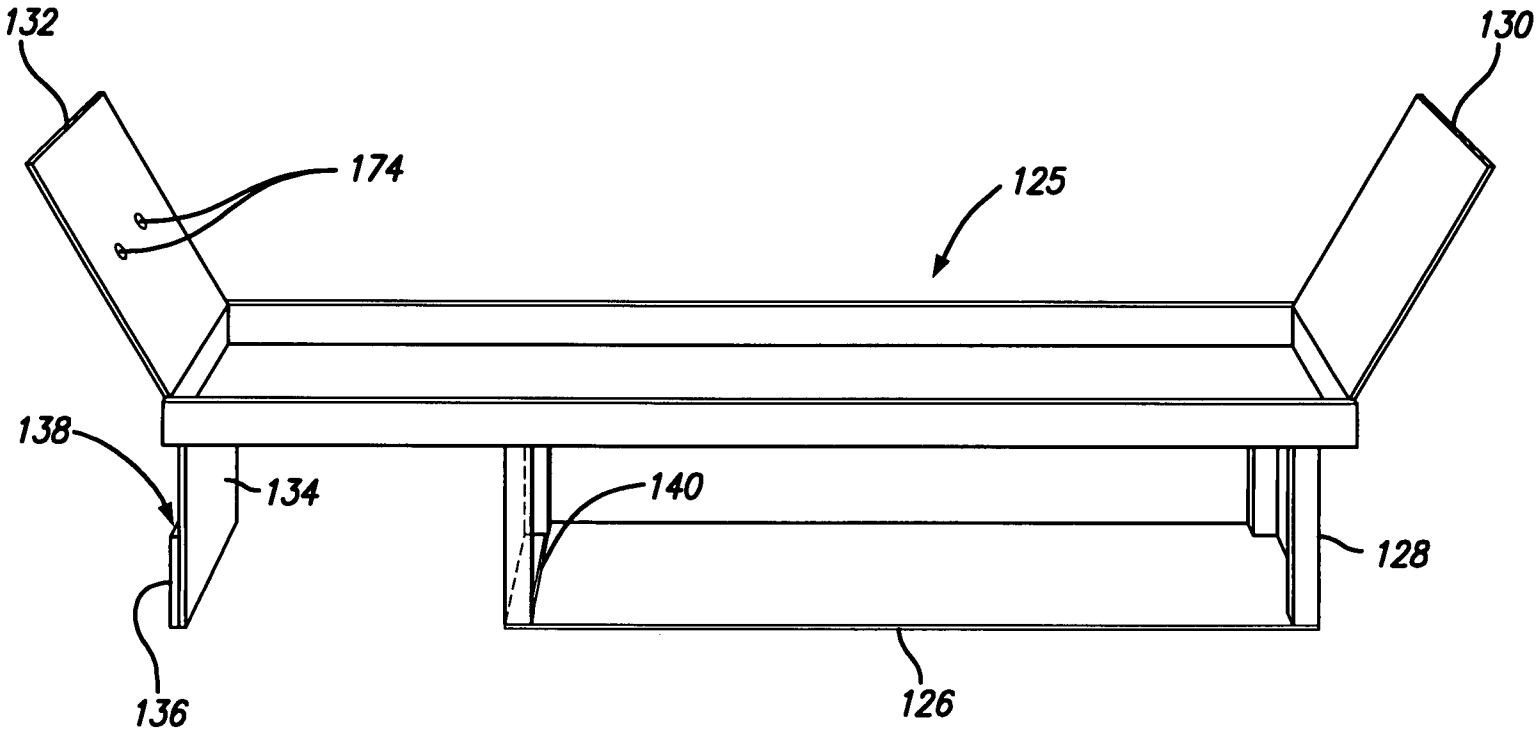
FIG. 10 is another view of the cabinet support structure of FIG. 8 showing the internal structure for supporting the drill press.

Referring to FIGS. 1 and 8-10, the drill press 118 is shown in the deployed position. FIG. 8 shows the drill press 118 in its stowed position inside the cabinet 12. FIG. 9 details how the drill press deploys from the stowed to the deployed position. FIG. 10 best shows the internal structure which supports the drill press 118 in the stowed position. In the deployed and stowed positions, the drill press 118 is mounted to the mounting panel 134. Mounting panel 134 is hinged by one or more hinges 138 to the cabinet side panels 142. Attached via hinges 138 to the mounting panel 134 is a flip stand support 136. On the free long edge of the flip stand support 136 is metal strip 138. Referring to FIG. 10, in side the cabinet 12 is a drill press support structure 125. The structure 125 comprises a platform 126 on which the drill press 118 rests. The platform is suspended within the cabinet by four legs 128. On the top surface of the free end of the platform 126 is a magnetic strip 140.

Referring to FIG. 8, the drill press is shown in the stowed position. To deploy the drill press, removable door 132 (see FIGS. 8 and 10) is removed by pulling the door free from face 110 of the cabinet 12 via thumbholes 174. Access door 130 is then rotated upwardly to an open position which provides access to the drill press 118. The drill press 118 is then rotated 90 degrees into a vertical position which causes the drill press mounting panel 134 to likewise rotate 90 degrees into a horizontal position flush with the face 110 of the cabinet 12. Once the drill press mounting panel 134 has been rotated upwards 90 degrees to a position flush with face 110, the flip stand support panel 136 is rotated downwardly by 90 degrees and the metal strip 138 on the flip stand panel 136 makes contact with the magnetic strip 140 on the platform panel 126 and thereby secures the flip stand support 136 into position. Thereafter, access door 130 is rotated downwardly until it is flush with face 110 of the cabinet 12 to provide a smooth work surface. Stowing the drill press from the deployed position back to the stowed position is the reverse of the above-described procedure.

Figure 11:
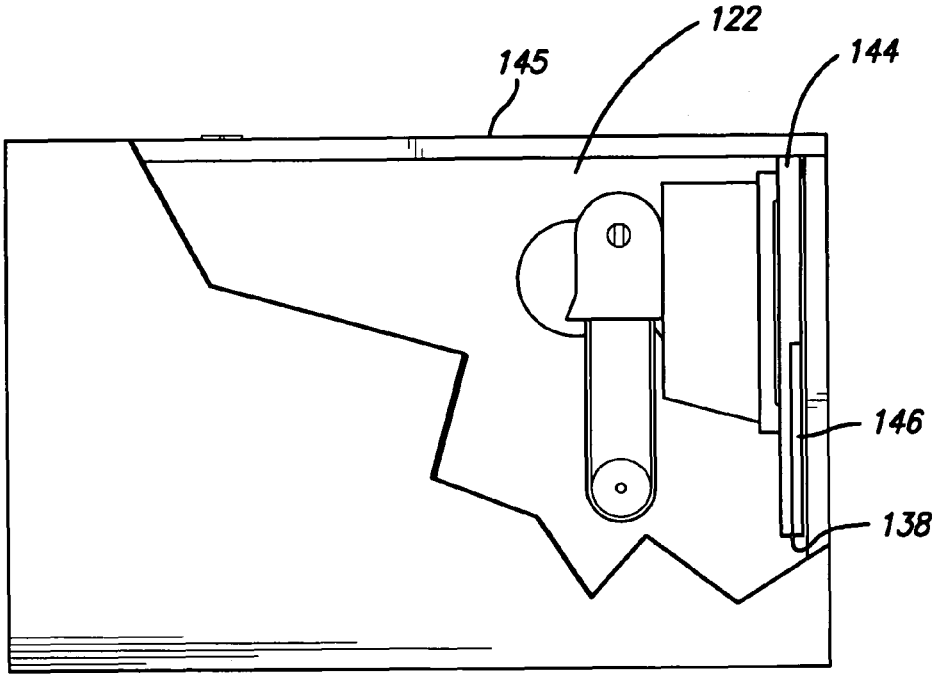
FIG. 11 is a side view, partially cutaway, of the rotating cabinet of FIG. 1, showing the belt sander face or work station in the topmost position and the belt sander in the stowed position within the cabinet.
Figure 12:
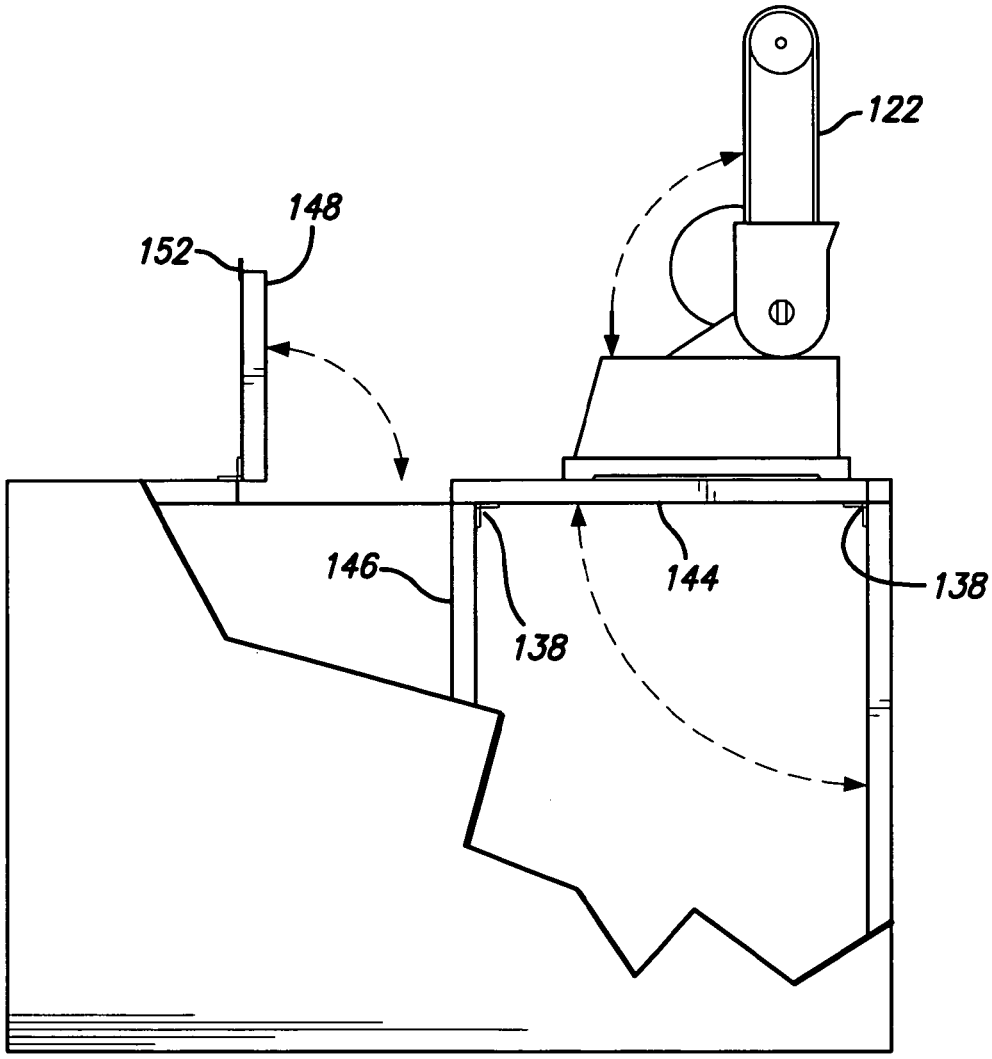
FIG. 12 is a side view, partially cutaway, of the rotating cabinet and workstation of FIG. 1, showing the belt sander face or work station in the topmost position and the belt sander in the deployed position.

With reference to FIGS. 11-12, the sander 124 is shown in its stowed and deployed positions, respectively. As described in detail for the drill press 118, the sander 124 is deployed and stowed using a similar flip stand arrangement that operates in essentially the same manner as that of the drill press 118. In particular, the sander is mounted to panel 144 which is attached via one or more hinges 138 to the side panel 142 of the cabinet 12. From the stowed position, a removable close out panel 148 (not shown) is removed from the face 114 of the cabinet 12. Panel 148 is then rotated upwardly approximately 90 degrees to provide access to the sander 124. The sander 124 is rotated upwardly about 90 degrees until it is flush with the cabinet face 116, at which time the flip stand 146 is rotated down to engage an internal support 150 (not shown) within the cabinet 12. Hinged access panel 148 is then rotated downwardly to a position flush with the face 116 of the cabinet 12. The panel 148 may be held in place by one or more latches 152, or, in other embodiments internal supports may be added to the cabinet 12. To provide a flush surface on the cabinet 12 when the sander is in the stored position, the cabinet is equipped with a close out panel 145 the closes out the opening in the cabinet when the sander is in the stowed or stored position. The closeout panel may be equipped with thumbholes or handles for ease of removal and installation.

Figure 13:
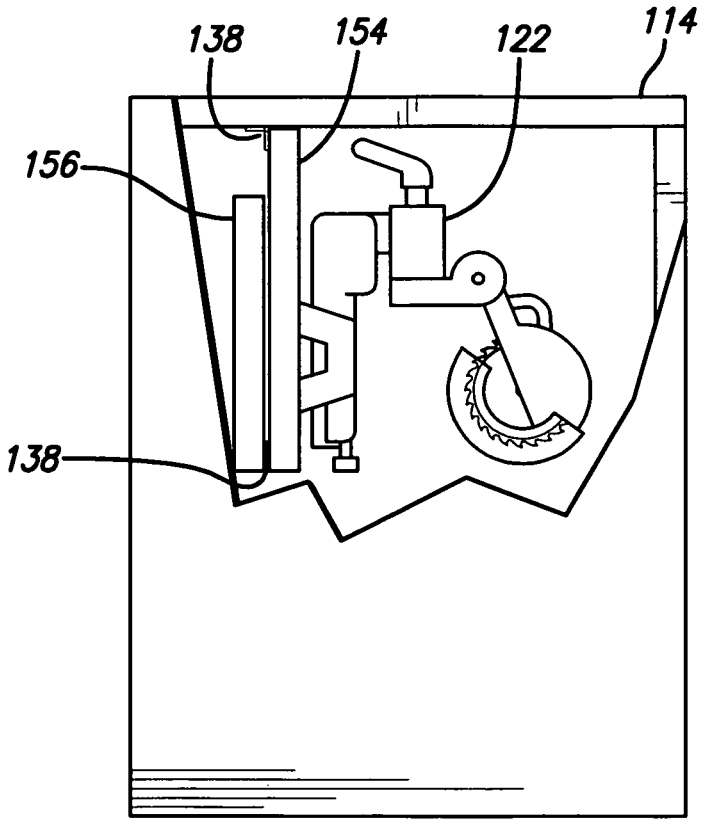
FIG. 13 is a side view, partially cutaway, of the rotating cabinet of FIG. 1, showing the miter saw work station in the topmost position and the miter saw in the stowed position within the cabinet.
Figure 14:
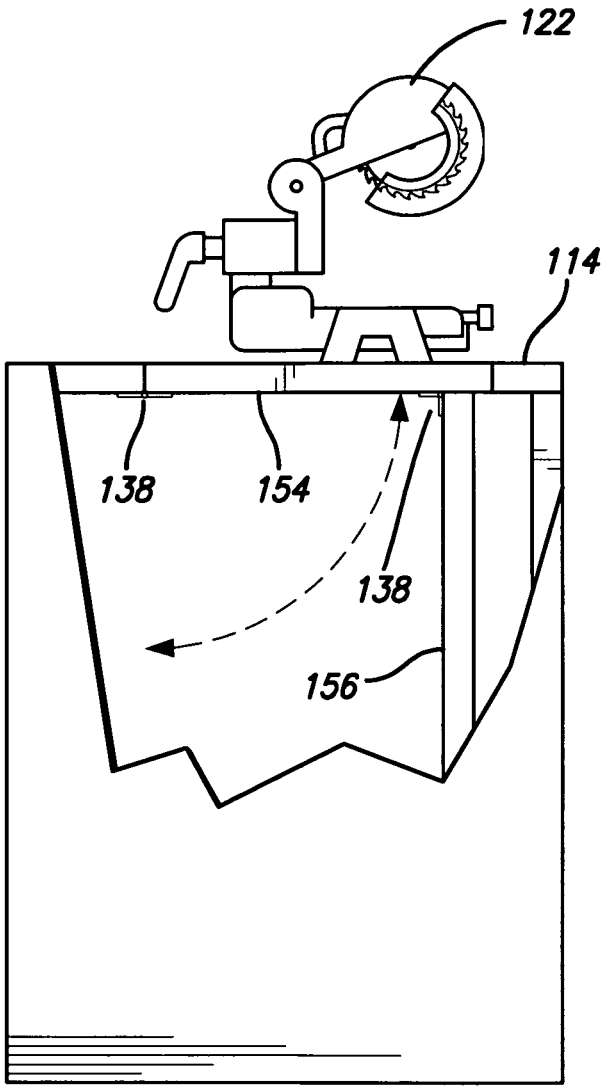
FIG. 14 is side view, partially cutaway, of the rotating cabinet of FIG. 1, showing the miter saw work station in the topmost position and the miter saw in the deployed position.

With reference to FIGS. 13 and 14, the miter saw 122 is shown in its stowed and deployed positions, respectively. Like the drill press 118 and the sander 124, the miter saw 122 is deployed and stowed using a flip stand arrangement. In particular, the miter saw is mounted to panel 154 which is attached via one or more hinges 138 to the side panel 142 of the cabinet 12. Mounting panel 154 to which is attached the miter saw 122 is then rotated upwardly approximately 90 degrees which brings the panel flush with the outer surface of the cabinet face 114. At this time, the flip stand 156 is rotated downwardly to engage an internal support 160 (not shown) within the cabinet 12. As with the sander 122, to provide a flush surface on the cabinet 12 when the miter saw is in the stored position, the cabinet is equipped with a close out panel 158 (see FIG. 16) the closes out the opening in the cabinet when the miter saw is in the stowed or stored position. The closeout panel may be equipped with thumbholes 174 (see FIG. 16) or handles or the like for ease of removal and installation.

Figure 15:
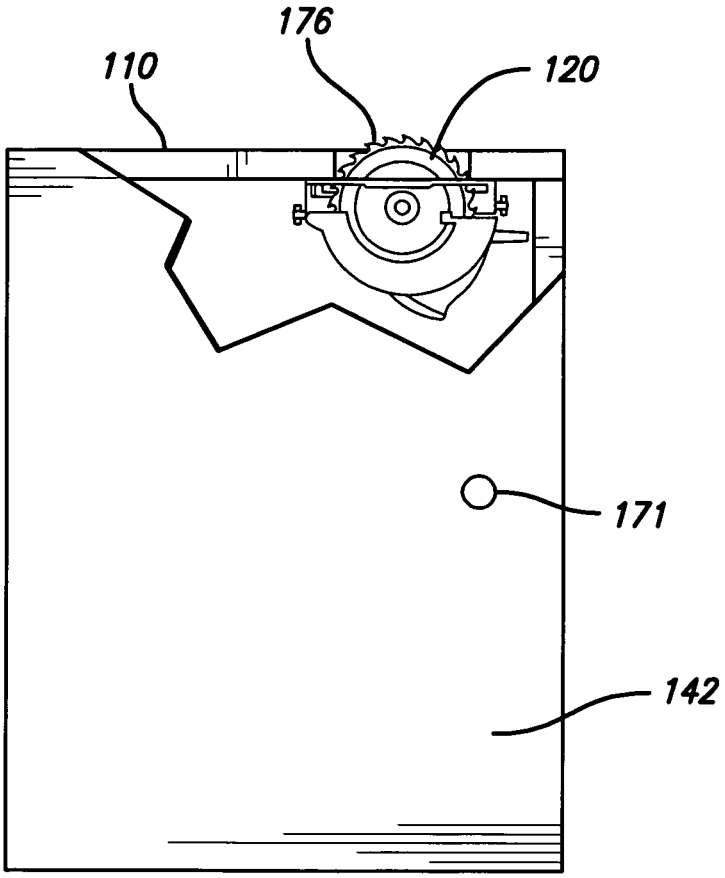
FIG. 15 is a side view, partially cutaway, of the rotating cabinet and workstation of FIG. 1, showing the table saw work station in the topmost position and the table saw in the deployed position within the cabinet.
Figure 16:
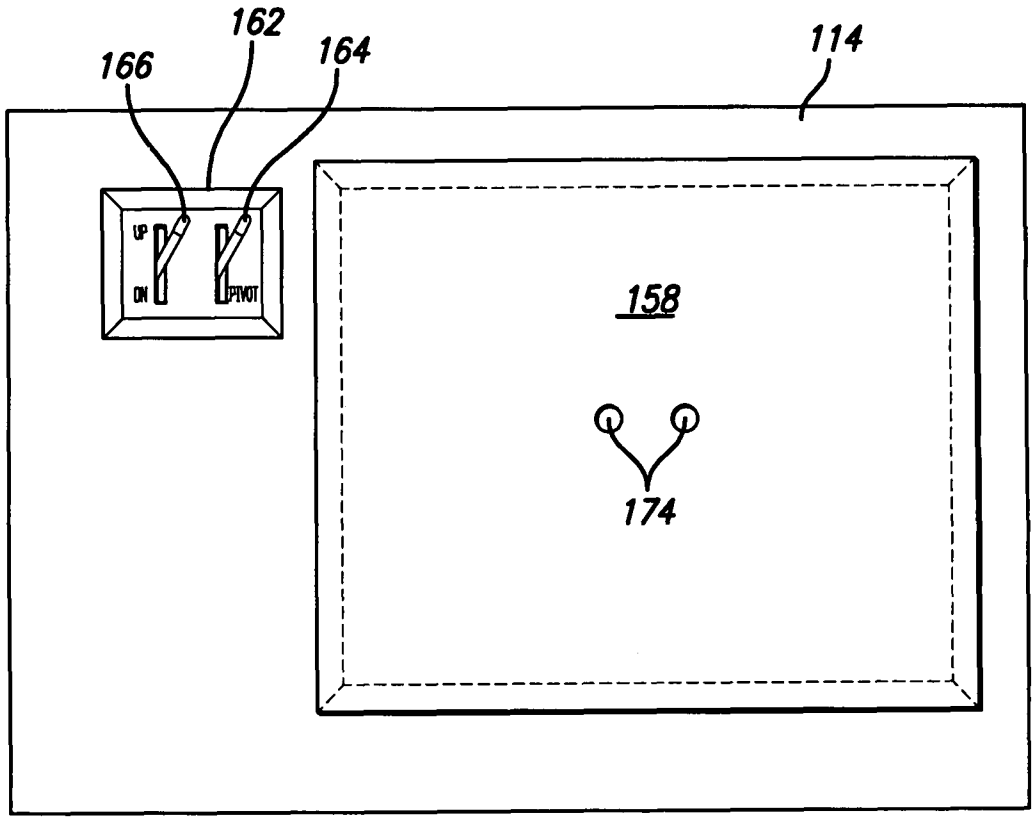
FIG. 16 is a side view, taken along the line A-A of FIG. 3, showing the table saw controls and the miter saw access panel.

Referring now to FIGS. 2, and 15-16, the table saw 120 is attached to the underside of face 112 of the cabinet 12. The table saw 120 has sufficient adjustability to lower the blade below the surface of the face 112 the table 12. On face 114 of the cabinet 12, is located a removable access panel 172 (now shown) with thumbholes 174 to allow the panel to be pulled away from the face 114. When access panel 172 is pulled away from face 114, an opening 162 is revealed which contains the table saw controls. (See FIG. 16.) In the opening 162 are two levers 164 and 166. Lever 166 allows the table saw 120 to be raised above the surface of face 114 through the blade access slot 170 or lowered below the surface of the face 114. Lever 164 controls the cutting angle of the table saw blade. Saws with sufficient adjustability to be used as the table saw of the present invention are commercially available from several sources. The saw used in the prototype of the present invention is available from _____, Model No. _____. An opening 171 may also be provided in the side panel 142 adjacent to the table saw 120 to allow for insertion of the hose of a shop vacuum to allow for the easy removal of saw dust.

Referring now to FIGS. 1-2, in one embodiment, the machine tool control switches and associated wiring are located in one of the triangular supports, while the main power and the air cylinder controls are located in the opposite support. In its most basic embodiment the present invention is provided with on/off type switches to operate the machine tools. With reference to FIG. 2, switches 178, 180, 182 and 184 are the table saw, miter saw, drill press and sander control switches, respectively. In FIG. 1 are shown switches for main electrical power 186, air cylinder activation 190 and air cylinder deactivation 188. The electrical wiring of such controls is known to those of skill in art. The switch locations shown are representative only. Other locations and more complex control circuitry may readily be added to the invention.

As is known to those of skill in the art, many different types of materials may be used to construct the triangular support sections, the air cylinder support assembly, the cabinet and other structural components of the present invention. The method of attachment of these sections and assemblies is largely dependant upon the material choice. For example, metallic materials such as steel and aluminum may be used and these materials would typically be fastened by welding or with bolts and rivets. The structures described above may also be formed from structural plastics in which case the assemblies may be co-molded or attached with structural adhesives and fasteners intended for use with these materials. Laminated or composite materials such as fiberglass and carbon fiber are also suitable for use in constructing the present invention. Plywood and non-laminated wood are also suitable materials from which the present invention may be fabricated.

Each of the machine tools described herein are held in their stowed positions with latches, straps and/or cords, as is known in the art, to prevent unwanted movement of the tools when the cabinet is rotated from one workstation to the next.

As described above, the present invention solves the problem of limited shop space in which to install power tools by providing a rotating rectangular cabinet in which is mounted, in the exemplary embodiment four bench type power tools, i.e. a drill press, table saw, miter saw and belt sander, each of which is stowed inside the cabinet in such manner that the tool can be deployed for use from the interior of the cabinet to an upright position on a corresponding exterior face of the cabinet, when that face has been rotated to the topmost position. The four exterior faces of the cabinet essentially provide the equivalent of four workbenches each of which is equipped with bench-type power tool.

In operation, a user raises the cabinet 12 by applying electrical power to a motor driven compressor 44 which pressurizes the air cylinders 26 causing them to raise the cabinet off 12 the base 14 and sufficiently high so that the cabinet 12 may be rotated bringing each face (which corresponds to a particular tool) to the topmost position. Pressure in the air cylinders 26 is then released which causes the cabinet to lower and again rest upon its base 14. When resting on the base 14, the cabinet supplies sufficient stability to allow for power tool operation. The majority of the tools are deployed using a flip-stand arrangement as described in detail above. In the exemplary embodiment, when raised the cabinet 12 is manually rotated to bring each face and its corresponding tool to the topmost position and the tools are manually deployed. However, in other embodiments, the cabinet may be rotated by means of an electric motor which may also include an indexed drive mechanism or the like. In addition, equipping each tool station with an electrically or hydraulically operated deployment mechanism is also possible.

The foregoing detailed description and appended drawings are intended as a description of the presently preferred embodiment of the invention and are not intended to represent the only forms in which the present invention may be constructed and/or utilized. Those skilled in the art will understand that modifications and alternative embodiments of the present invention which do not depart from the spirit and scope of the foregoing specification and drawings, and of the claims appended below are possible and practical. It is intended that the claims cover all such modifications and alternative embodiments.

The invention claimed is:

1. A multi-position cabinet for the storage and deployment of deployable devices comprising:

a rotatable cabinet assembly from which deployable devices may be stored and deployed for use;

a base assembly;

a side support assembly on one side of the cabinet and another side support assembly on an opposite side of the cabinet, the side support assemblies including means for raising the cabinet to a raised position from an at rest position, wherein the cabinet may be rotated while in the raised position, the means for raising the cabinet further including the ability to lower the cabinet from the raised position back to the at rest position on the base assembly;

attachment means for attaching the cabinet to the side support assemblies so as to allow the cabinet to rotate when in the raised position;

wherein for each side support assembly, the means for raising and lowering the cabinet is connected to at least one slide assembly which slides upwardly and downwardly between one or more slide tracks; and wherein the at least one slide assembly comprises two slide blocks between which is fitted a bearing block, the bearing block assembly being connected to the means or raising and lowering the cabinet.

2. The multi-position cabinet of claim 1, wherein the means of raising and lower the cabinet from the base assembly is selected from the group comprising air cylinders, hydraulic cylinders and bail screws.

3. The multi-position cabinet of claim 1, wherein the attachment means for rotatably connecting the cabinet to each opposing side support assembly is capable of passing electrical cabling from telescoping cable storage assemblies to the interior of the rotatable cabinet.

4. The multi-position cabinet of claim of claim 1, wherein the cabinet includes at least one face which has at least one deployable device stored inside the cabinet under the face, the device being deployable to the top of the face for use.

5. The multi-position cabinet of claim of claim 4, wherein the deployable device under at least one face of the cabinet is connected to a hinged mounting panel inside the cabinet, the hinged mounting panel being capable of rotating upwardly to a position flush with the face, the hinged mounting panel including a flip stand panel hinged to the mounting panel's free end, the flip stand panel being deployable downwardly to engage an internal support inside the cabinet, wherein when the flip stand panel is engaged with the internal support the hinged mounting panel is supported flush with face and the deployable device is then accessible for use.

6. A multi-position cabinet for the storage and deployment of deployable devices comprising:

a rotatable cabinet assembly from which deployable devices may be stored and deployed for use;

a base assembly;

a side support assembly on one side of the cabinet and another side support assembly on an opposite side of the cabinet, the side support assemblies including means for raising the cabinet to a raised position from an at rest position, wherein the cabinet may be rotated while in the raised position, the means for raising the cabinet further including the ability to lower the cabinet from the raised position back to the at rest position on the base assembly;

attachment means for attaching the cabinet to the side support assemblies so as to allow the cabinet to rotate when in the raised position;

wherein the cabinet includes at least one face which has at least one deployable device stored inside the cabinet under the face, the device being deployable to the top of the face for use;

wherein the deployable device under at least one face of the cabinet is connected to a hinged mounting panel inside the cabinet, the hinged mounting panel being capable of rotating upwardly to a position flush with the face, the hinged mounting panel including a flip stand panel hinged to the mounting panel's free end, the flip stand panel being deployable downwardly to engage an internal support inside the cabinet, wherein when the flip stand panel is engaged with the internal support the hinged mounting panel is supported flush with face and the deployable device is then accessible for use; and wherein the flip stand panel having one end hinged to the mounting panel and an opposite end free to engage the internal support, further includes a metal strip on its free end, the internal support further including a magnetic strip wherein the metal strip on the flip stand panel engages the magnetic strip on internal support, whereby a more stable support is provided for the deployable device when the flip stand is deployed.

7. The multi-position cabinet of claim 6, wherein the means for raising and lowering the cabinet is an air cylinder which is provided with pressurized air by a motor driven compressor and wherein the air cylinder, compressor and motor are each contained within the side support assembly.

8. A multi-position cabinet for the storage and deployment of deployable devices comprising:

a rotatable cabinet assembly from which deployable devices may be stored and deployed for use;

a base assembly;

a side support assembly on one side of the cabinet and another side support assembly on an opposite side of the cabinet, the side support assemblies including means for raising the cabinet to a raised position from an at rest position, wherein the cabinet may be rotated while in the raised position, the means for raising the cabinet further including the ability to lower the cabinet from the raised position back to the at rest position on the base assembly;

attachment means for attaching the cabinet to the side support assemblies so as to allow the cabinet to rotate when in the raised position;

wherein the cabinet includes at least one face which has at least one deployable device stored inside the cabinet under the face, the device being deployable to the top of the face for use; and wherein the cabinet includes at least four faces, each face having at least one deployable device stored inside the cabinet under the face, the device being deployable to the top of the face for use.

9. A multi-position cabinet for the storage and deployment of machine tools comprising:

a rotatable cabinet assembly having at least one face from which machine tools may be stored and deployed for use;

a base assembly;

a side support assembly on one side of the cabinet and another side support assembly on an opposite side of the cabinet, the side support assemblies including means for raising the cabinet to a raised position from an at rest position, wherein the cabinet may be rotated while in the raised position, the means for raising the cabinet further including the ability to lower the cabinet from the raised position back to the at rest position on the base assembly;

attachment means for attaching the cabinet to the side support assemblies so as to allow the cabinet to rotate when in the raised position;

wherein for each side support assembly the means for raising and lowering the cabinet is connected to at least one slide assembly which slides upwardly and downwardly between one or more slide tracks; and wherein the at least one slide assembly comprises two slide blocks between which is fitted a bearing block, the bearing block assembly being connected to the means for raising and lowering the cabinet.

10. The multi-position cabinet of claim 9, wherein the means of raising and lower the cabinet from the base assembly is selected from the group comprising air cylinders, hydraulic cylinders and ball screws.

11. The multi-position cabinet of claim 9, wherein the attachment means for rotatably connecting the cabinet to each opposing side support assembly is capable of passing electrical cabling from telescoping cable storage assemblies to the interior of the rotatable cabinet.

12. The multi-position cabinet of claim of claim 9, wherein the cabinet includes at least one face which has at least one machine, tool stored inside the cabinet under the face, the machine tools being deployable to the top of the face for use.

13. The multi-position cabinet of claim of claim 12, wherein the machine tool under at least one face of the cabinet is connected to a hinged mounting panel inside the cabinet, the hinged mounting panel being capable of rotating upwardly to a position flush with the face, the hinged mounting panel including a flip stand panel hinged to the mounting panel's free end, the flip stand panel being deployable downwardly to engage an internal support inside the cabinet, wherein when the flip stand panel is engaged with the internal support the hinged mounting panel is supported flush with face and the machine tool is then accessible for use.

14. A multi-position cabinet for the storage and deployment of machine tools comprising:

a rotatable cabinet assembly having at least one face from which machine tools may be stored and deployed for use;

a base assembly;

a side support assembly on one side of the cabinet and another side support assembly on an opposite side of the cabinet, the side support assemblies including means for raising the cabinet to a raised position from an at rest position, wherein the cabinet may be rotated while in the raised position, the means for raising the cabinet further including the ability to lower the cabinet from the raised position back to the at rest position on the base assembly;

attachment means for attaching the cabinet to the side support assemblies so as to allow the cabinet to rotate when in the raised position;

wherein the cabinet includes at least one face which has at least one machine tool stored inside the cabinet under the face, the machine tools being deployable to the top of the face for use, wherein the machine tool under at least one face of the cabinet is connected to a hinged mounting panel inside the cabinet, the hinged mounting panel being capable of rotating upwardly to a position flush with the face, the hinged mounting panel including a flip stand panel hinged to the mounting panel's free end, the flip stand panel being deployable downwardly to engage an internal support inside the cabinet, wherein when the flip stand panel is engaged with the internal support the hinged mounting panel is supported flush with face and the machine tool is then accessible for use;

wherein the flip stand panel having one end hinged to the mounting panel and an opposite end free to engage the internal support, further includes a metal strip on its free end, the internal support further including a magnetic strip wherein the metal strip on the flip stand panel engages the metal strip on internal support, whereby a more stable support is provided when the machine tool and consequently the flip stand is deployed.

15. The multi-position cabinet of claim 14, wherein the means for raising and lowering the cabinet is an air cylinder which is provided with pressurized air by a motor driven compressor and wherein the air cylinder, compressor and motor are each contained within the side support assembly.

16. A multi-position cabinet for the storage and deployment of deployable devices comprising:

a rotatable cabinet assembly from which devices may be stored and deployed for use;

the cabinet including at least one face which has at least one device stored inside the cabinet under the face, the device being deployable to the top of the face for use;

wherein the device under the at least one face of the cabinet is connected to a hinged mounting panel inside the cabinet, the hinged mounting panel being capable of rotating upwardly to a position flush with the face, the hinged mounting panel including a flip stand panel hinged to the mounting panel's free end, the flip stand panel being deployable downwardly to engage an internal support inside the cabinet, wherein when the flip stand panel is engaged with the internal support the hinged mounting panel is supported flush with face and the machine tool is then accessible for use;

a base assembly;

a side support assembly on one side of the cabinet and another side support assembly on an opposite side of the cabinet, the side support assemblies including means for raising the cabinet to a raised position from an at rest, wherein the cabinet may be rotated while in the raised position, the means for raising the cabinet further including the ability to lower the cabinet from the raised position back to the at rest position on the base assembly;

wherein for each side support assembly the means for raising and lowering the cabinet is connected to at least one slide assembly which slides upwardly and downwardly between one or more slide tracks;

wherein the at least one slide assembly comprises two slide blocks between which is fitted a bearing block, the bearing block assembly being connected to the means for raising and lowering the cabinet; and attachment means for attaching the cabinet to the bearing block assemblies of the slide assemblies so as to allow the cabinet to rotate when in the raised position.

* * * * *